US011524864B2

(12) United States Patent
Mahoney et al.

(10) Patent No.: US 11,524,864 B2
(45) Date of Patent: Dec. 13, 2022

(54) METHOD FOR UNDERSTANDING AND PLANNING ELEVATOR USE

(71) Applicant: Otis Elevator Company, Farmington, CT (US)

(72) Inventors: Sally Day Mahoney, New Hartford, CT (US); Michael C. Schiappa, Burlington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 1162 days.

(21) Appl. No.: 16/045,154

(22) Filed: Jul. 25, 2018

(65) Prior Publication Data

US 2020/0031611 A1 Jan. 30, 2020

(51) Int. Cl.

| | |
|---|---|
| ***B66B 1/34*** | (2006.01) |
| ***B66B 1/24*** | (2006.01) |
| ***B66B 5/00*** | (2006.01) |

(52) U.S. Cl.

CPC ..... *B66B 1/2408* (2013.01); *B66B 1/34* (2013.01); *B66B 5/0025* (2013.01); *B66B 2201/406* (2013.01)

(58) Field of Classification Search

CPC ... B66B 5/0025; B66B 5/0031; B66B 5/0018; B66B 1/3461; B66B 3/00; B66B 5/02; B66B 5/0087; B66B 5/0037; B66B 5/0006; B66B 5/00; B66B 1/3446; B66B 1/3415; B66B 3/002; B66B 25/006; B66B 5/021; B66B 13/14; B66B 1/36

See application file for complete search history.

(56) References Cited

U.S. PATENT DOCUMENTS

| | | | | |
|---|---|---|---|---|
| 4,860,207 | A | 8/1989 | Kubo | |
| 7,712,587 | B2 | 5/2010 | Kim et al. | |
| 10,766,738 | B2 | 9/2020 | Hsu et al. | |
| 10,829,342 | B2 | 11/2020 | Pasini et al. | |
| 2017/0174470 | A1* | 6/2017 | Salmikuukka | B66B 5/0018 |
| 2018/0022574 | A1* | 1/2018 | Pasini | B66B 11/0407 187/247 |
| 2019/0210837 | A1* | 7/2019 | Herkel | B66B 5/027 |
| 2019/0373530 | A1* | 12/2019 | Witczak | B66B 1/34 |

(Continued)

FOREIGN PATENT DOCUMENTS

| | | | |
|---|---|---|---|
| CN | 102656109 | A | 9/2012 |
| CN | 102923538 | A | 2/2013 |

(Continued)

OTHER PUBLICATIONS https://max.thyssenkrupp-elevator.com/en/ (13 pages).

(Continued)

*Primary Examiner* — Marlon T Fletcher
(74) *Attorney, Agent, or Firm* — Cantor Colburn LLP

(57) ABSTRACT

An elevator management system includes an elevator system and a service provider controller. The elevator system is configured to control at least one elevator car and to transmit a status message indicating status data of the at least one elevator car. The service provider controller is configured to determine a current operating mode of the at least one elevator car based on the status message and to assign the at least one elevator car to a current status group among a plurality of different status groups based on the current operating mode.

9 Claims, 5 Drawing Sheets

(56) References Cited

U.S. PATENT DOCUMENTS

| | | | | |
|---|---|---|---|---|
| 2020/0346890 | A1* | 11/2020 | Michaelidis | B66B 1/3492 |
| 2020/0361745 | A1* | 11/2020 | Pahlke | B66B 13/02 |

FOREIGN PATENT DOCUMENTS

| | | | | | |
|---|---|---|---|---|---|
| CN | 103019159 | A | | 4/2013 | |
| CN | 202880605 | U | | 4/2013 | |
| CN | 204022161 | U | | 12/2014 | |
| CN | 204689281 | U | | 10/2015 | |
| CN | 105731209 | A | | 7/2016 | |
| CN | 104627769 | B | | 3/2017 | |
| CN | 106542388 | A | | 3/2017 | |
| CN | 107133673 | A | | 9/2017 | |
| CN | 107200248 | A | | 9/2017 | |
| CN | 107207184 | A | | 9/2017 | |
| CN | 107207185 | A | | 9/2017 | |
| CN | 107273554 | A | | 10/2017 | |
| CN | 104627752 | B | | 12/2017 | |
| CN | 105110111 | B | | 5/2018 | |
| CN | 108046073 | A | | 5/2018 | |
| CN | 113716409 | A | * | 11/2021 | B66B 1/3453 |
| EP | 2336070 | B1 | | 8/2016 | |
| EP | 3575256 | A1 | * | 12/2019 | B66B 1/3446 |
| EP | -3670415 | A2 | * | 6/2020 | B66B 5/0025 |
| EP | 3915919 | A1 | * | 12/2021 | B66B 1/3453 |
| GB | 2514355 | A | | 11/2014 | |
| KR | 20170016637 | A | * | 2/2017 | |
| KR | 20170123992 | A | | 11/2017 | |
| WO | WO-2013055346 | A1 | * | 4/2013 | B66B 1/3461 |
| WO | WO-2015198459 | A1 | * | 12/2015 | B66B 5/00 |
| WO | 2017081507 | A1 | | 5/2017 | |
| WO | 2017093595 | A1 | | 6/2017 | |
| WO | WO-2017093595 | A1 | * | 6/2017 | B66B 1/2466 |
| WO | 2018050253 | A1 | | 3/2018 | |

OTHER PUBLICATIONS https://www.ibm.com/watson/stories/kone/ (5 pages).

Office Action and Search Report issued in Chinese Patent Application No. 201910672674.9; Application Filing Date Jul. 24, 2019; dated May 31, 2021 (8 pages).

Extended European Search Report for European Application No. 19188454.3; Application Filing Date Jul. 25, 2019; dated Dec. 6, 2019 (8 pages).

* cited by examiner

METHOD FOR UNDERSTANDING AND PLANNING ELEVATOR USE

BACKGROUND

The present disclosure is related to passenger conveyor systems, and more particularly, to elevator management and control systems.

Elevators are key resources in current building schemes and structural designs. The ability to effectively move people through a building is related to the number of elevators available to service customers at any particular time. However, elevator cars can be scheduled to operate out of normal service, sometimes referred to as "out-of-group". For example, an elevator car can be operating "in-group" and made available to service calls input by a customer, or can be scheduled out-of-group to allow for maintenance events, emergency events, freight service, and operation testing.

Conventional elevator systems also allow authorized personnel to manually invoke different operating modes of an elevator car. Thus, an elevator car may be manually taken out-of-group until the authorized personnel reinvokes the normal operating mode of the elevator, i.e., manually returns the elevator car into the servicing group.

BRIEF DESCRIPTION

Disclosed is an elevator management system that includes an elevator system and a service provider controller. The elevator system is configured to control at least one elevator car and to transmit a status message indicating status data of the at least one elevator car. The service provider controller is configured to determine a current operating mode of the at least one elevator car based on the status message and to assign the at least one elevator car to a current status group among a plurality of different status groups based on the current operating mode.

According to another non-limiting feature, the service provider controller is located remotely from the elevator system.

According to another non-limiting feature, the status message is continuously transmitted according to a transmit time.

According to another non-limiting feature, the elevator management system further comprises a user interface in signal communication with the service provider controller, the user interface configured to display the different status groups and to identify the at least one elevator car in the assigned current status group.

According to another non-limiting feature, the user interface is configured to the display the status information of the at least one elevator car.

According to another non-limiting feature, the service provider controller automatically updates the user interface in response to a change in the status data.

According to another non-limiting feature, the service provider controller updates the user interface by assigning the at least one elevator car to a different status group among the plurality of status groups in response to determining a change in the operating mode.

According to another non-limiting feature, the service provider controller determines whether at least one of a number of elevator cars operating in-group is above or below a threshold number assigned for passenger use.

According to another non-limiting feature, the service provider controller commands the user interface to display an alert when the number of elevator cars operating in-group falls below the threshold number.

According to another non-limiting feature, the service provider controller determines an optimal day and time to remove an elevator car from an in-group mode based on historical data and displays the optimal day and time on the user interface.

According to another non-limiting feature, the service provider controller automatically schedules removal of at least one elevator cars from operating in an in-group mode.

According to another non-limiting feature, the service provider controller automatically invokes an out-of-group mode of an out-of-group elevator car in response to removing the out-of-group elevator car from the in-group mode.

According to another non-limiting feature, the service provider controller calculates at least one of elevator car, group and building availability for a given time period, and commands the user interface to display the calculated availability.

Also disclosed is a method of managing an elevator system. The method comprises controlling, via an elevator system, at least one elevator car, transmitting, via the elevator system, a status message indicating status data of the at least one elevator car, determining, via a service provider controller, a current operating mode of the at least one elevator car based on the status message, and assigning the at least one elevator car to a current status group among a plurality of different status groups based on the current operating mode.

According to another non-limiting feature, the service provider controller is located remotely from the elevator system.

According to another non-limiting feature, the method further comprises continuously transmitting the status message according to transmit time.

According to another non-limiting feature, the method further comprises displaying, via a user interface in signal communication with the service provider controller, the different status groups to identify the at least one elevator car in the assigned current status group.

According to another non-limiting feature, the method further comprises displaying, via the user interface, the status information of the at least one elevator car based on the transmitted status message.

According to another non-limiting feature, the method further comprises detecting, via the service provider controller, a change in the status data, and automatically updating the user interface, via the service provider controller, in response to the change in the status data.

According to another non-limiting feature, updating the user interface further comprises determining, via the service provider controller, a change in the operating mode, and assigning the at least one elevator car to a different status group among the plurality of status groups in response to the change in the operating mode.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

The term "about" is intended to include the degree of error associated with measurement of the particular quantity based upon the equipment available at the time of filing the application.

Various non-limiting embodiments described herein provide an elevator management system that offers customers and maintenance providers the ability to efficiently schedule one or more elevators out-of-group. In addition, the elevator management system provides a service provider with real-time information on the operating status of one more elevator cars. In this manner, an out-of-group elevator car can be quickly identified and brought back into the service without requiring significant on-site maintenance servicing. In this manner, customer satisfaction is improved while providing a client the opportunity to reduce costs incurred from service provider on-site maintenance.

In one or more non-limiting embodiments, the elevator management system also provides the ability to view past history of elevator operations. If a customer has a complaint about elevator wait times, a historical view of the elevator cars in a group can be displayed to show the number of elevator cars available "in-group" for any time period. The system can automatically display whether the elevators "in-group" for a given time period is above or below a threshold for an acceptable service level. When the number of "in-group" elevator cars fall below the threshold, the customer can view whether the service level was affected by elevator malfunctions, or by the customer putting the elevator into an 'out-of-group" mode. The historical in-group availability can also be used to have the system automatically recommend the best day and time to take a car "out-of-group" (e.g., for maintenance, special modes, etc.) to least effect the elevator service level.

Figure 1:
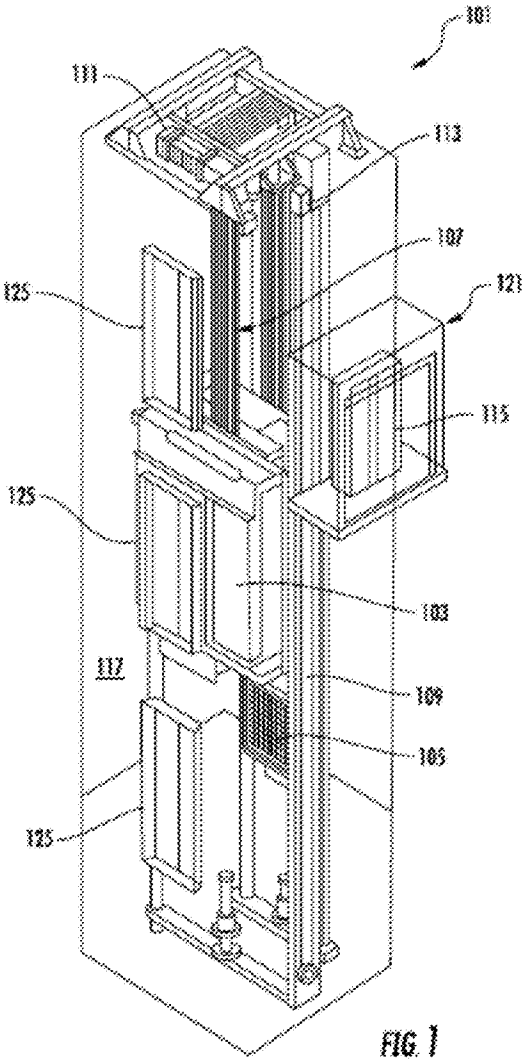
FIG. 1 is a schematic illustration of an elevator system that may employ various embodiments of the present disclosure.

With reference to FIG. 1, a perspective view of an elevator system 101 is illustrated according to a non-limiting embodiment of the present disclosure. The elevator system includes an elevator car 103, a counterweight 105, a tension member 107, a guide rail 109, a machine 111, a position reference system 113, and a system controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The tension member 107 engages the machine 111, which is part of an overhead structure of the elevator system 101. The machine 111 is configured to control movement between the elevator car 103 and the counterweight 105. The position reference system 113 may be mounted on a fixed part at the top of the elevator shaft 117, such as on a support or guide rail, and may be configured to provide position signals related to a position of the elevator car 103 within the elevator shaft 117. In other embodiments, the position reference system 113 may be directly mounted to a moving component of the machine 111, or may be located in other positions and/or configurations as known in the art. The position reference system 113 can be any device or mechanism for monitoring a position of an elevator car and/or counter weight, as known in the art. For example, without limitation, the position reference system 113 can be an encoder, sensor, or other system and can include velocity sensing, absolute position sensing, etc., as will be appreciated by those of skill in the art.

The system controller 115 is located, as shown, in a controller room 121 of the elevator shaft 117 and is configured to control the operation of the elevator system 101, and particularly the elevator car 103. For example, the system controller 115 may provide drive signals to the machine 111 to control the acceleration, deceleration, leveling, stopping, etc. of the elevator car 103. The system controller 115 may also be configured to receive position signals from the position reference system 113 or any other desired position reference device. When moving up or down within the elevator shaft 117 along guide rail 109, the elevator car 103 may stop at one or more landings 125 as controlled by the system controller 115. Although shown in a controller room 121, those of skill in the art will appreciate that the controller 115 can be located and/or configured in other locations or positions within the elevator system 101. In one embodiment, the system controller 115 may be located remotely or in the cloud.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator shaft 117.

Although shown and described with a roping system including tension member 107, elevator systems that employ other methods and mechanisms of moving an elevator car within an elevator shaft may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. FIG. 1 is merely a non-limiting example presented for illustrative and explanatory purposes.

In other embodiments, the system comprises a conveyance system that moves passengers between floors and/or along a single floor. Such conveyance systems may include escalators, people movers, etc. Accordingly, embodiments described herein are not limited to elevator systems, such as that shown in FIG. 1. In one example, embodiments disclosed herein may be applicable conveyance systems such as an elevator system 101 and a conveyance system component such as an elevator car 103 of the elevator system 101. In another example, embodiments disclosed herein may be applicable conveyance systems such as an escalator system and a conveyance system component such as a moving stair of the escalator system.

Figure 2:
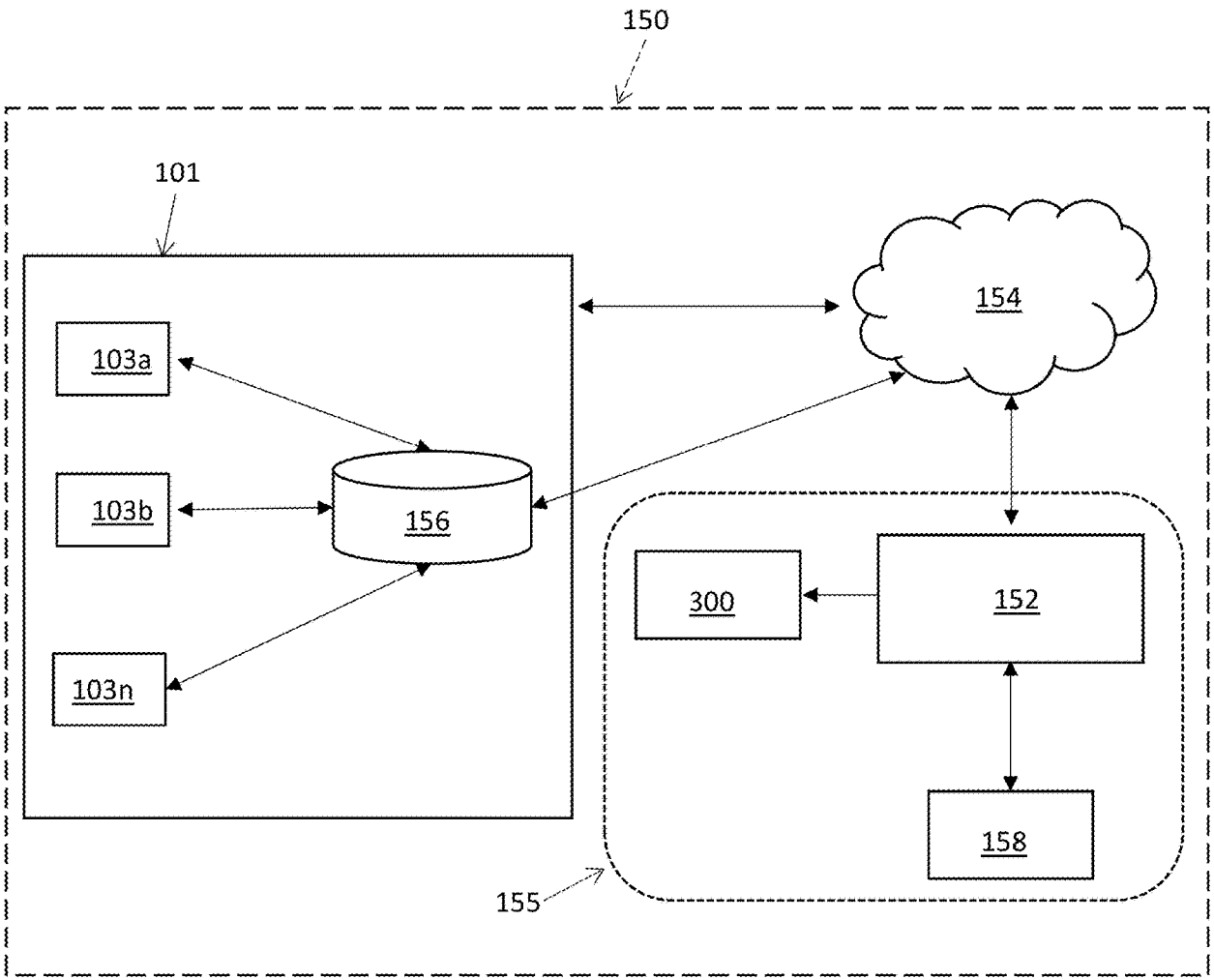
FIG. 2 is a block diagram illustrating an elevator management system according to a non-limiting embodiment of the present disclosure.

Turning now to FIG. 2, an elevator management system 150 is illustrated according to a non-limiting embodiment of the present disclosure. The elevator management system 150 includes a service provider controller 152 in signal communication with an elevator system 101 via a data communication network 154. The elevator system 101 includes one or more elevator cars 103*a*, 103*b*, 103*n*, which operate as described in in detail above with reference FIG. 1. The elevator system 101 further includes a data storage device 156. The data storage device 156 includes a memory unit or data server, for example, configured to store operating data corresponding to the elevator system 101. The storage device 156 can be employed locally, remotely and/or in a cloud network. The operating data includes, but is not limited to, elevator status history, elevator mode history, ride history information, and maintenance history information.

The elevator management system 150 further includes one or more terminal devices 158 and an elevator management user interface 300. In one or more non-limiting embodiments, the service provider controller 152, the terminal device 158 and/or the elevator management user interface 300 can be collectively referred to as an elevator management service provider system 155. The terminal device is capable of providing user data to the service provider controller 152. The terminal device 158 can include various types of computing devices such as, for example, a desktop computing workstation, laptop computer, a tablet computer, a smart phone, a smart watch, or other wearable smart computing devices. The user data includes a wide variety of data including, but not limited to, surrounding environmental data, location data, and elevator maintenance data.

The terminal device 158 is also configured to provide the service provider controller 152 with customer data. The customer data includes, for example, requests to schedule one or more elevator out-of-group. For instance, a customer may use a terminal device 158 to submit a request to schedule an elevator 103*a* for freight delivery on selected day and time. The service provider controller 152 can analyze the history of operating status of a given elevator system 101 to determine whether the day and time requested will conflict with the elevator system's capability based on the operation status history of the elevator system over time. If the history suggests that the day and time selected by the user typically involves a high-rate of out-of-group elevator cars (e.g., due to student move-in weekend for example), the service provider controller 152 can send a message to the customer denying the request and asking the user to submit an alternative day and/or time.

When the service provider controller 152 grants the customer's request, the service provider controller 152 can automatically send the customer a reminder message about the scheduled out-of-group event, add the scheduled out-of-group event to the customer's electronic calendar, etc. On the day of the scheduled out-of-group event, the service provider controller 152 is configured to automatically invoke the operating mode of an elevator car 103*a*, 103*c*, 103*n*. For example, the service provider controller 152 can automatically invoke the freight mode of elevator car 103*a* during the time frame requested by the user, and send a message to the customer indicating which elevator car is ready to perform the requested service and the current location of the elevator car. In another example, the service provider controller 152 can automatically override a manual attempt to place one or more elevator cars 103*a*, 103*b*, 103*n* out of group when the number of in-group elevator cars falls below a threshold number. In this manner, the service provider controller 152 can aim to keep a selected number of elevator cars in-group to ensure customers can be serviced at all times.

The service provider controller 152 is configured to receive status data from the elevator system 101. The status data includes, but is not limited to, elevator door state (i.e., are the door open or closed) door state time, elevator car travel direction, current operating modes of the elevator cars, current locations of the elevator cars (current floor or landing), passengers in car, etc.

The current operating modes can be grouped into categories. The categories may include, for example, serving passengers, avail for passenger use, out of service or powered down, maintenance, special customer modes, freight loading/delivery, and emergency modes. The status data can also include diagnostic data, which indicates reasons why an elevator car 103*a*, 103*b*, 103*n* is not servicing customer calls.

Each elevator car 103*a*, 103*b*, 103*n* can communicate its status data by transmitting a status message to the service provider controller 152 according to a set transmit time, e.g., every 10-20 seconds. It should be appreciated, however, that the transmit time is programmable and that other transmit times can be employed. Accordingly, the frequent transmission of status data provides a time period snapshot of the usage of the elevator system 101, along with the current operating status of each elevator car 103*a*, 103*b*, 103*n*. This data can be presented across a group of elevator cars 103*a*, 103*b*, 103*n* of an entire building to ascertain times at which the elevator cars 103*a*, 103*b*, 103*n* are available for passenger use is below a critical point for acceptable building service. The frequently transmitted status data can also be utilized by the service provider to schedule maintenance at times that are least likely to inconvenience the customer. The service provider controller 152 can provide a visualization of the elevator system 101 based on the status data using the elevator management user interface 300 as described in greater detail below.

In one or more embodiments, the service provider controller 152 is configured to perform one or more elevator system management operations. The management operations include, but are not limited to, (1) determining whether the current or historical number of elevator cars 103*a*, 103*b*, 103*n* operating "in-group" is above or below a threshold number assigned for passenger use, (2) issuing a warning when the number of elevator cars 103*a*, 103*b*, 103*n* "in-group" falls below the threshold number, (3) recommending an optimal day and time to remove an elevator car 103*a*, 103*b*, 103*n* from an in-group mode (i.e., allow an elevator car to operate out-of-group) based on historical data, (4) automatically scheduling removal of elevator cars 103*a*, 103*b*, 103*n* from operating in-group and placing one or more elevator cars 103*a*, 103*b*, 103*n* in an out-of-group mode based on recommendation, and (5) calculating elevator car, group and/or building availability (not in shutdown mode) for any time period. In at least one embodiment, the time period can be manually input to the service provider controller 152 (e.g., by a customer or building operator).

In at least one non-limiting embodiment, an "in-group" threshold number can be selected by the customer or building operator. For instance, a building operator may desire to have a predetermined number of elevator cars 103*a*, 103*b*, 103*n* operating "in-group" during specified times to maintain acceptable customer service to its building riders. The building operator may allow for require a higher number of elevator cars 103*a*, 103*b*, 103*n* to operate "in-group" during weekday business hours, compared to weekend hours.

Accordingly, a first "in-group" threshold can be set for weekday business hours (e.g., Monday through Friday, from 8:00 AM to 5:00 PM), while a different threshold number (e.g., a lower threshold) can be set for weekend hours (e.g., Saturday and Sunday).

Figure 3:
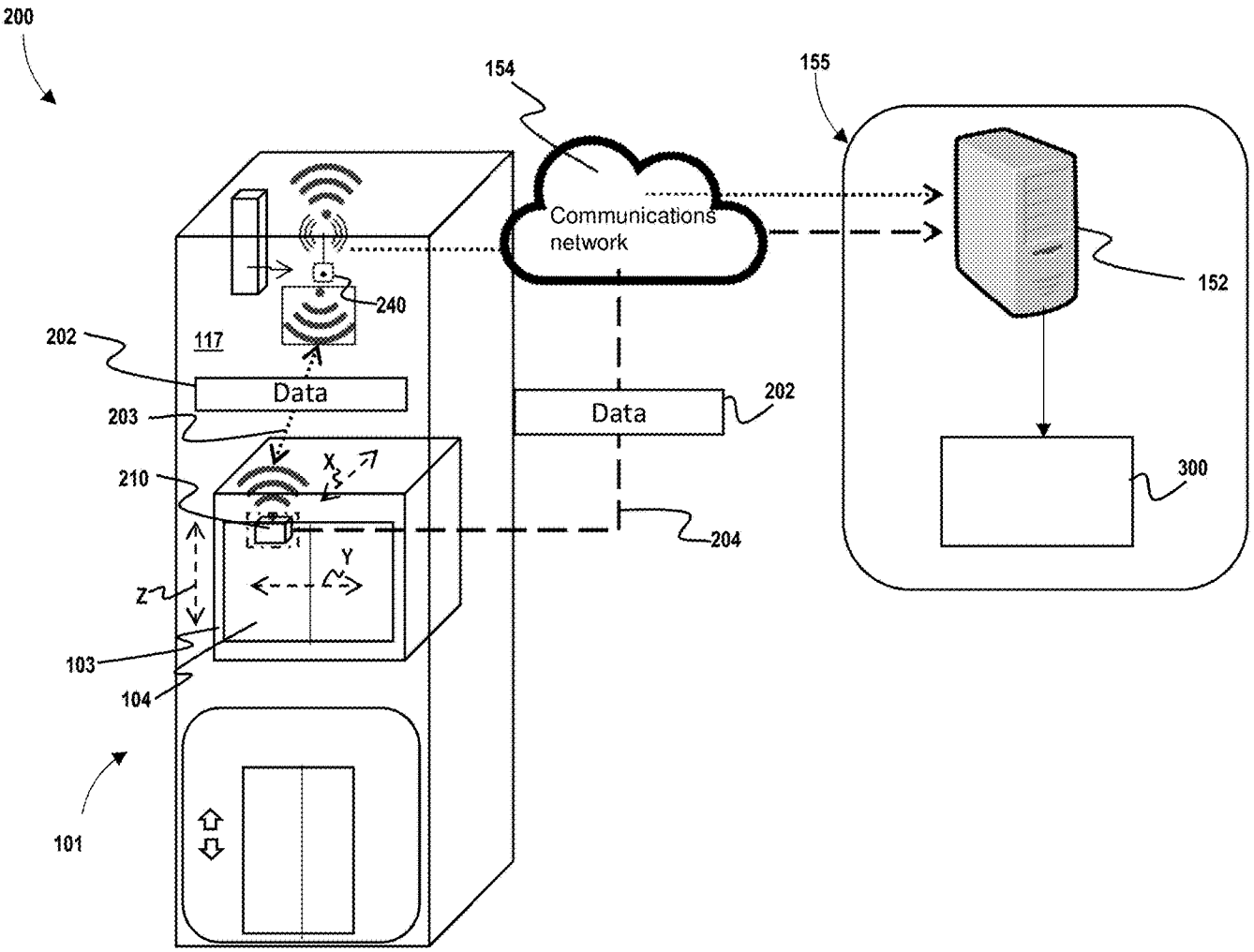
FIG. 3 depicts an elevator car data exchange system in accordance with a non-limiting embodiment of the present disclosure.

FIG. 3 is a view of an elevator car data exchange system 200 configured to transmit data such as elevator car status data, for example, according to an embodiment of the present disclosure. The elevator car data exchange system 200 includes one or more sensors 210 configured to detect various types of data 202 of the elevator car 103 and transmit the data 202 to processing system. The processing system can be employed locally or can be a remote system 152 such as the service provider controller 152, for example, over communications network 154. In an embodiment, the sensor 210 is configured to process the data 202 prior to transmitting the data 202 to the remote system 152.

The processing of the data 202 may reveal data including, but not limited to, a number of elevator door openings/closings, elevator door time, vibrations, a number of elevator rides, elevator ride performance, and elevator flight time, current elevator car location, and current elevator door status (i.e., open-door state or closed-door state). Although the sensor 210 is illustrated as being installed on the elevator car 103 itself, it should be appreciated that sensors can be included at different locations of the elevator system 101 (e.g., in the elevator shaft 117). In other embodiments, individual sensors are not required to get the data. For example, some systems map use information from sensors, others may use data from the elevator system controller 115.

The remote system 152 may be a computing device, such as, for example, a desktop computer, server, etc. The remote system 152 may also be a mobile computing device that is typically carried by a person, such as, for example a smartphone, PDA, smartwatch, tablet, laptop, etc. The remote system 152 may also be two separate devices that are synced together, such as, for example, a cellular phone and a desktop computer synced over an internet connection. In one or more embodiments, the remote system 152 can be implemented using a distributed computing platform (e.g., cloud computing). The remote system 152 may use data 202 from the sensor 210 to manage the elevator system 101. For example, a user operating a work station that implements the service provider controller 152 can utilized the data 202 to optimize in-group/out-of-group car scheduling, current elevator system operating state analysis, remote diagnostic analysis, determine historical elevator availability (uptime) rates, determine historical car in group rates, and/or remote elevator car operating mode control.

The sensor 210 is configured to transmit the data 202 to the remote system 152 via wired protocols (not shown), short-range wireless protocols 203 and/or long-range wireless protocols 204. Short-range wireless protocols 203 may include but are not limited to Bluetooth, Wi-Fi, HaLow (801.11ah), Wireless M-Bus, Zigbee, zWave. Using short-range wireless protocols 203, the sensor 210 is configured to transmit the data 202 to a local gateway device 240. The local gateway device 240 is configured to transmit the data 202 to the remote system 152 through a communications network 154. The communications network 154 may be a cellular network, satellite network, wired network, or any other communications network known to one of skill in the art. Using long-range wireless protocols 204, the sensor 210 is configured to transmit the data 202 to the remote system 152 through the communications network 154. Long-range wireless protocols 204 may include but are not limited to cellular, GSM, CDMA, LTE (NB-IoT, CAT M1), LoRa, or SigFox.

FIG. 3 shows a possible installation location of the sensor 210 within the elevator system 101. In an embodiment, the sensor 210 may be attached to a door 104 of the elevator car 103. By attaching the sensor 210 to the door 104 of the elevator car 103 the sensor 210 may detect accelerations of the elevator car 103 and the doors 104 of the elevator car 103. For example, when located on the door 104, the sensor 210 may detect when the elevator car 103 is in motion, when the elevator car 103 is slowing, when the elevator car 103 is stopping, and when the doors 104 open to allow passengers to exit and enter the elevator car 103. It is understood that the sensor 210 may also be installed in other locations other than a door 104 of the elevator system 101. The sensor 210 may be configured to detect acceleration in any number of directions. In an embodiment, the sensor may detect accelerations in three directions, a first direction X, a second direction Y, and a third direction Z, as show in in FIG. 2. The first direction X may be perpendicular to the doors 104 of the elevator car 103, as shown in FIG. 2. The second direction Y may be parallel to the doors 104 of the elevator car 103, as shown in FIG. 2. The third direction Z may be aligned vertically parallel with the elevator shaft 117 and pull of gravity, as shown in FIG. 2. In another embodiment, the car status may be determined by connecting to the existing elevator system controller and collecting status through a communication link (wired serial or bus communications, LAN, wireless, etc.).

Figure 4:
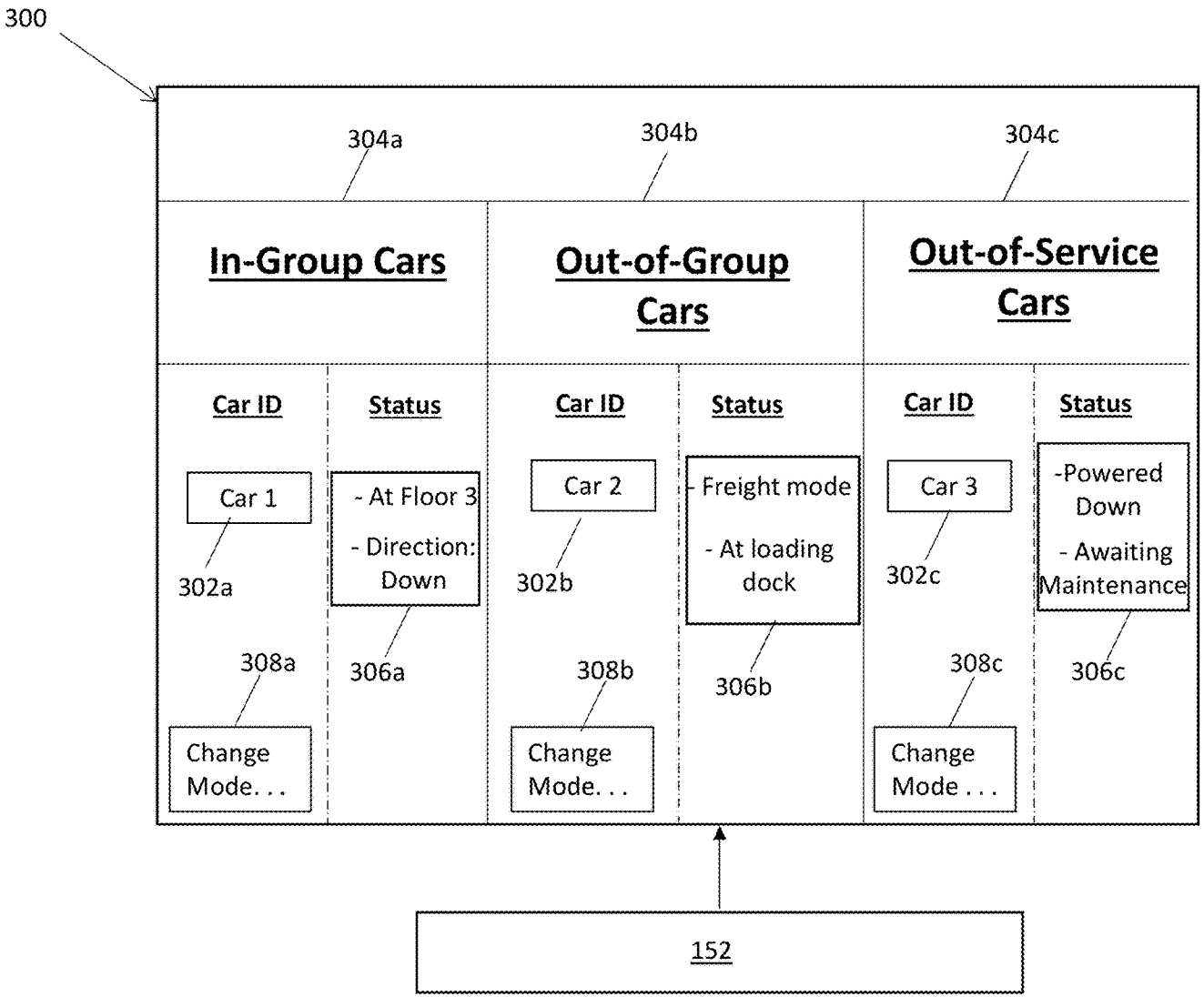
FIG. 4 depicts an elevator management user interface according to a non-limiting embodiment of the present disclosure.

Turning now to FIG. 4, an elevator management user interface 300 is illustrated according to a non-limiting embodiment. The elevator management user interface 300 can be generated and controlled by the service provider controller 152. In at least one embodiment, the elevator management user interface 300 can also be provided to a user terminal device (see FIG. 1, 158). In this manner, a customer, tenant, etc., can monitor the status of the elevator system and determine the status of the elevator cars. This allows a customer to determine which elevator cars are currently operating in-group, along with which elevators are currently out of group, operating in an "out-of-group mode", also referred to as an "out-of-group mode" (e.g., freight service, independent service, VIP service).

The elevator management user interface 300 displays an elevator car identifier (ID) 302*a*, 302*b* and 302*c* for each elevator car included in a given elevator system, and categorizes the elevator cars into status groups 304*a*, 304*b* and 304*c* based on the status messages received from each respective car. The status groups include, but are not limited to, an "in-group" status 304*a*, an "out-of-group mode" status 304*b*, and an "out-of-service" status 304*c*.

The in-group status group 304*a* includes the elevator cars which are currently operating in-group and available to service customer calls. The independent mode status group 304*b* includes elevator cars operating in various out-of-group status modes. The "out-of-group status" modes include, but are not limited to, freight status, independent service, VIP service, emergency status, maintenance status, etc. In this example, elevators included in the "out-of-group mode" status group differ from the elevator cars included in the out-of-service status group 304*c* in that cars operating in the "out-of-group mode" are powered on, but have been taken out-of-group to perform a particular service while ignoring general customer calls. These cars, however, can be returned to the "in-group" status 304*a* once its "out-of-group mode" service has been completed. The "out-of-service"

cars, however, are powered down due to maintenance issues or are otherwise out of routine operation, for example, and cannot be placed back into the "in-group" status until elevator maintenance on the car has been completed.

The elevator management user interface 300 further displays status information 306*a*, 306*b* and 306*c* corresponding to each elevator car. The status information can actively change based on the status message received from each elevator car. In this manner, a service provider can analyze the elevator management user interface 300, and quickly determine the current status of a given elevator system during real time.

The elevator management user interface 300 may also include a mode change selector 308*a*, 308*b* and 308*c*, which allows the service provider to remotely change the operating mode of a given elevator car. For example, a service provider can remotely deactivate the freight mode of elevator car 302*b* after freight servicing has been completed and return elevator car 302*b* in-group. Accordingly, the elevator management user interface 300 is updated by removing elevator car 302*b* from the "out-of-group mode" 304*b* category and adding it to the "in-group" category 304*a*. In this manner, the elevator system is brought up-to-date in real time. In another example, the service provider can remotely power on an out-of-service elevator car (e.g., car 302*c*) and/or remotely perform a system reset using the mode change selector 308*c*.

Figure 5:
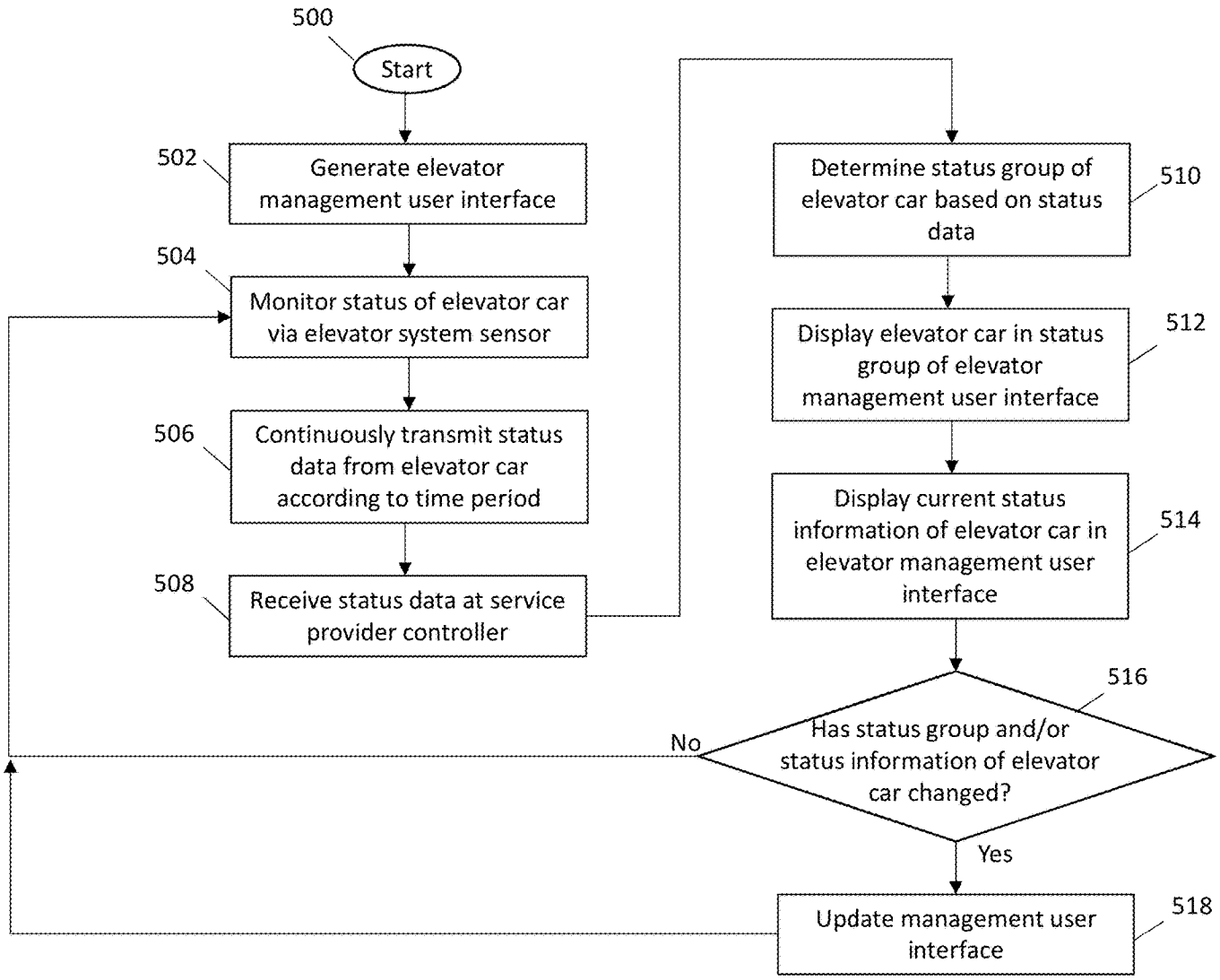
FIG. 5 is a flow diagram illustrating a method of managing an elevator system according to a non-limiting embodiment.

Turning now to FIG. 5, a flow diagram illustrates a method of managing an elevator system according to a non-limiting embodiment. The method begins at operation 500, and at operation 502 an elevator management user interface is generated. The elevator management user interface can be generated using a service provider controller and can be operated remotely from the elevator system. At operation 504, the status of one or more elevator cars included in the elevator system is monitored. The status of a given elevator car is monitored using one or more sensors installed on the elevator car and/or in the elevator system or by connecting to the elevator system controller through a wired or wireless connection to obtain status data. At operation 506, the elevator car status is continuously transmitted from the elevator car and/or elevator system according to a transmit time. In at least one embodiment, transmit time is every 10-20 seconds, for example.

At operation 508, the transmitted elevator car status is received at the service provider controller. The service provider controller can be located remotely from the elevator system and can be installed on a workstation operated by a service provider operator or can be running on a remote server or in the cloud. At operation 510, the service provider controller determines a status group of the elevator car based on the elevator car status. At operation 512, the determined status group of the elevator car is displayed on the elevator management user interface. At operation 514, current status information indicated by the transmitted status data is also displayed on the elevator management user interface.

At operation 516, a determination is made as to whether the status group and/or the status information of the elevator car has changed. In at least one embodiment, the service provider controller can automatically determine a change in the status group and/or the status information of the elevator car. When the status group and/or the status information has not changed, the method returns to operation 504 and continues monitoring the status of the elevator car. When, however, the status group and/or the status information has changed, the elevator management user interface is updated accordingly at operation 518, and the method returns to operation 504 to continue monitoring the status of the elevator car.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. An elevator management system, comprising:

an elevator system configured to control at least one elevator car and to transmit a status message that continuously transmitted according to a transmit time, the status message indicating status data of the at least one elevator car;

a service provider controller located remotely from the elevator system and configured to determine a current operating mode of the at least one elevator car based on the status message and to assign the at least one elevator car to a current status group among a plurality of different status groups based on the current operating mode; and a user interface in signal communication with the service provider controller, the user interface configured to display the status information of the at least one elevator car and to display the different status groups and to identify the at least one elevator car in the assigned current status group, wherein the service provider controller determines whether at least one of a number of elevator cars operating in-group is above or below a threshold number assigned for passenger use and automatically updates the user interface in response to a change in the status data.

2. The elevator management system of claim 1, wherein the service provider controller updates the user interface by assigning the at least one elevator car to a different status group among the plurality of status groups in response to determining a change in the operating mode.

3. The elevator management system of claim 1, wherein the service provider controller commands the user interface to display an alert when the number of elevator cars operating in-group falls below the threshold number.

4. The elevator management system of claim 1, wherein the service provider controller determines an optimal day and time to remove an elevator car from an in-group mode based on historical data and displays the optimal day and time on the user interface.

5. The elevator management system of claim 1, wherein the service provider controller automatically schedules removal of at least one elevator cars from operating in an in-group mode.

6. The elevator management system of claim 5, wherein the service provider controller automatically invokes an out-of-group mode of an out-of-group elevator car in response to removing the out-of-group elevator car from the in-group mode.

7. The elevator management system of claim 1, wherein the service provider controller calculates at least one of elevator car, group and building availability for a given time period, and commands the user interface to display the calculated availability.

8. A method of managing an elevator system, the method comprising:

controlling, via an elevator system, at least one elevator car;

continuously transmitting, via the elevator system, a status message according to transmit time, the status message indicating status data of the at least one elevator car;

determining, via a service provider controller located remotely from the elevator system, a current operating mode of the at least one elevator car based on the status message; and assigning the at least one elevator car to a current status group among a plurality of different status groups based on the current operating mode;

displaying, via a user interface in signal communication with the service provider controller, the different status groups to identify the at least one elevator car in the assigned current status group;

detecting, via the service provider controller, a change in the status data; and automatically updating the user interface, via the service provider controller, in response to the change in the status data, wherein the service provider controller determines whether at least one of a number of elevator cars operating in-group is above or below a threshold number assigned for passenger use and automatically updates the user interface in response to a change in the status data.

9. The method of claim 8, wherein updating the user interface further comprises:

determining, via the service provider controller, a change in the operating mode; and assigning the at least one elevator car to a different status group among the plurality of status groups in response to the change in the operating mode.

* * * * *